US006308602B1

(12) United States Patent
Gerber

(10) Patent No.: US 6,308,602 B1
(45) Date of Patent: Oct. 30, 2001

(54) APPARATUS FOR BITE CUTTING MADE TO ORDER GARMENTS

(75) Inventor: Heinz Joseph Gerber, West Hartford, CT (US)

(73) Assignee: Gerber Scientific, Inc., South Windsor, CT (US)

( * ) Notice: Subject to any disclaimer, the term of this patent is extended or adjusted under 35 U.S.C. 154(b) by 1032 days.

(21) Appl. No.: 08/929,012

(22) Filed: Sep. 8, 1997

Related U.S. Application Data

(63) Continuation of application No. 08/385,440, filed on Feb. 8, 1995, now abandoned.

(51) Int. Cl.[7] ..... B26D 5/20; B26D 7/20; A41H 43/00; B26F 1/38

(52) U.S. Cl. ..... 83/76.6; 83/100; 83/227; 83/276; 83/282; 83/422

(58) Field of Search ..... 101/288, DIG. 48, 101/DIG. 49, DIG. 30; 3/941, 56, 282, 375, 206, 100, 155, 155.1, 227, 225, 276, 266, 259, 260, 358, 359, 422; 83/76.6

(56) References Cited

U.S. PATENT DOCUMENTS

| | | | | |
|---|---|---|---|---|
| 3,747,454 | * | 7/1973 | Gerber | 83/375 |
| 3,844,461 | | 10/1974 | Robison et al. . | |
| 4,028,167 | | 6/1977 | Gerber . | |
| 4,091,980 | | 5/1978 | Gerber | 226/162 |
| 4,178,820 | * | 12/1979 | Gerber | 83/941 |
| 4,366,023 | * | 12/1982 | Voltmer | 156/542 |
| 4,373,412 | * | 2/1983 | Gerber et al. | 83/24 |
| 4,685,363 | * | 8/1987 | Gerber | 83/941 |
| 4,730,526 | | 3/1988 | Pearl et al. | 83/71 |
| 4,850,579 | * | 7/1989 | Fisher | 83/941 |
| 4,961,149 | * | 10/1990 | Schneider et al. | 83/175 X |
| 5,061,947 | * | 10/1991 | Morrison et al. | 101/288 |
| 5,092,829 | | 3/1992 | Gerber | 493/351 |
| 5,119,704 | * | 6/1992 | Wolfson | 83/941 |
| 5,141,572 | | 8/1992 | Gerber | 156/64 |
| 5,214,590 | * | 5/1993 | Schnetzer | 83/34 |
| 5,548,519 | | 8/1996 | Park et al. . | |

FOREIGN PATENT DOCUMENTS

| | | | |
|---|---|---|---|
| 4409195 A1 | | 9/1994 | (DE) . |
| 0198274 A1 | | 10/1986 | (EP) . |
| 0445494 A1 | | 9/1991 | (EP) . |
| 0 476 398 A2 | | 5/1992 | (EP) . |
| 0 514 685 A1 | | 11/1992 | (EP) . |
| 2586959 A | | 3/1987 | (FR) . |
| 2 129 761 A | | 5/1984 | (GB) . |
| 2133731 | * | 8/1984 | (GB) ..... 83/49 |

OTHER PUBLICATIONS

Preliminary Search Report.
"Découpe de costumes: laser et temps réel" Mesures Regulation Automatisme. vol. 52, No. 14, Nov. 23, 1987, Paris.

* cited by examiner

*Primary Examiner*—Rinaldi I. Rada
*Assistant Examiner*—Charles Goodman
(74) *Attorney, Agent, or Firm*—McCormick, Paulding & Huber LLP

(57) ABSTRACT

An apparatus and method for cutting pattern pieces from a continuous marker are disclosed. According to the invention, pattern pieces comprising made to order garments are cut from successive bites of limp sheet material. Means are provided for creating the continuous marker, labeling the pattern pieces and cutting the pattern pieces for subsequent processing.

7 Claims, 4 Drawing Sheets

APPARATUS FOR BITE CUTTING MADE TO ORDER GARMENTS

This is a continuation of application Ser. No. 08/385,440 filed on Feb. 8, 1995 now abandoned.

FIELD OF THE INVENTION

This invention relates generally to an apparatus for cutting an array of pattern pieces defined by a marker from single ply sheet materials, such as fabric. More particularly, the invention is concerned with a compact, low cost, fully automated apparatus for cutting pattern pieces for made to order garments from successive bites or segments of sheet material.

BACKGROUND OF THE INVENTION

It is well-known in the art of apparel manufacturing to cut individual garment parts or pattern pieces from a strip of fabric according to a marker which defines both the contours of the individual pattern pieces and the arrangement of the individual pattern pieces relative to one another as they are to be cut from the fabric. The marker is generated automatically by, for example, a computer aided design system, and the marker information is converted into machine command signals which direct a cutting tool along a cutting path corresponding to the contours of the pattern pieces.

Typically, successive segments of the fabric are delivered to the cutting tool by a conveyor table which has an in-feed portion for receiving the fabric from one or more supply rolls, a cutting station where successive segments of the fabrics are cut by the cutting tool according to the marker instructions, and a discharge end where the cut pattern pieces are separated from the remainder of the fabric. Such tables also typically include a vacuum system for holding the fabric or other sheet material firmly against the surface of the table during the cutting operation.

Conveyorized cutting tables are large, complicated and expensive devices widely utilized in the mass production of garments where a large number of pattern pieces must be cut within a relatively short period of time. However, in cases where one or only a few copies of a particular garment are being produced, such as in the made to order production of garments, the use of such a large and expensive conveyorized cutting table is impracticable. As used herein the term "made to order garment" means a standard-sized garment manufactured for a specific individual, a custom fitted garment manufactured for a specific individual based on the individual's physical measurements, or a garment manufactured from a prototype design. Moreover, where production is limited to one or only a few copies of a single garment, there may not be a sufficient number of individual pattern pieces to arrange them according to the marker instructions in a manner which utilizes the available fabric efficiently.

Accordingly, it is an object of the present invention to provide an inexpensive cutting apparatus of simplified construction for use in the manufacture of made to order garments.

It is a further object of the invention to provide such an apparatus wherein pattern pieces are arranged by marker in a manner which makes efficient use of each segment of a sheet material from which the pattern pieces are cut.

It is a still further object of the invention to provide a method of cutting pattern pieces for use in the made to order manufacture of garments.

SUMMARY OF THE INVENTION

In one aspect, the present invention resides in an apparatus for segment-by-segment or bite cutting of pattern pieces from limp sheet material such as fabric. The apparatus includes means for receiving data representing made to order garments, and means for generating a continuous marker based on the data. As used herein, the term "continuous marker" refers to a marker that continuously defines pattern pieces comprising made to order garments or groups of garments as data defining such garments are received. The marker arranges the pattern pieces on one or more bites of the sheet material and controls the size of each bite so as to achieve optimum use of the material.

The apparatus further includes a carriage for precisely controlling the movement of a cutting tool according to the marker instructions over a stationary work surface on which the limp sheet of material is spread. The carriage includes means for releasably coupling the sheet material to the carriage for movement therewith and relative to the table to deliver successive bites of the sheet material to the work surface. Labeling means are also provided for labeling each pattern piece in order to identify the particular garment to which it belongs. A vacuum source together with means communicating with the vacuum source and with the work surface are provided for applying vacuum to the sheet material spread thereon.

In a second aspect, the invention resides in a method for bite cutting pattern pieces comprising made to order garments. The method includes the steps of receiving data representing plurality of made to order garments; generating a continuous marker from the data, wherein the marker provides a set of instructions defining the contours of the pattern pieces, the arrangement of the pattern pieces relative to one another for cutting from successive bites of limp sheet material, and the size of each bite of sheet material; supporting the sheet material in a spread condition on a work surface; precisely controlling the movement of a cutting tool over the work surface according to the marker instructions to cut the pattern pieces from the sheet of material; and labeling each pattern piece to identify the custom fitted garment to which it belongs.

DETAILED DESCRIPTION OF THE INVENTION

Figure 1:
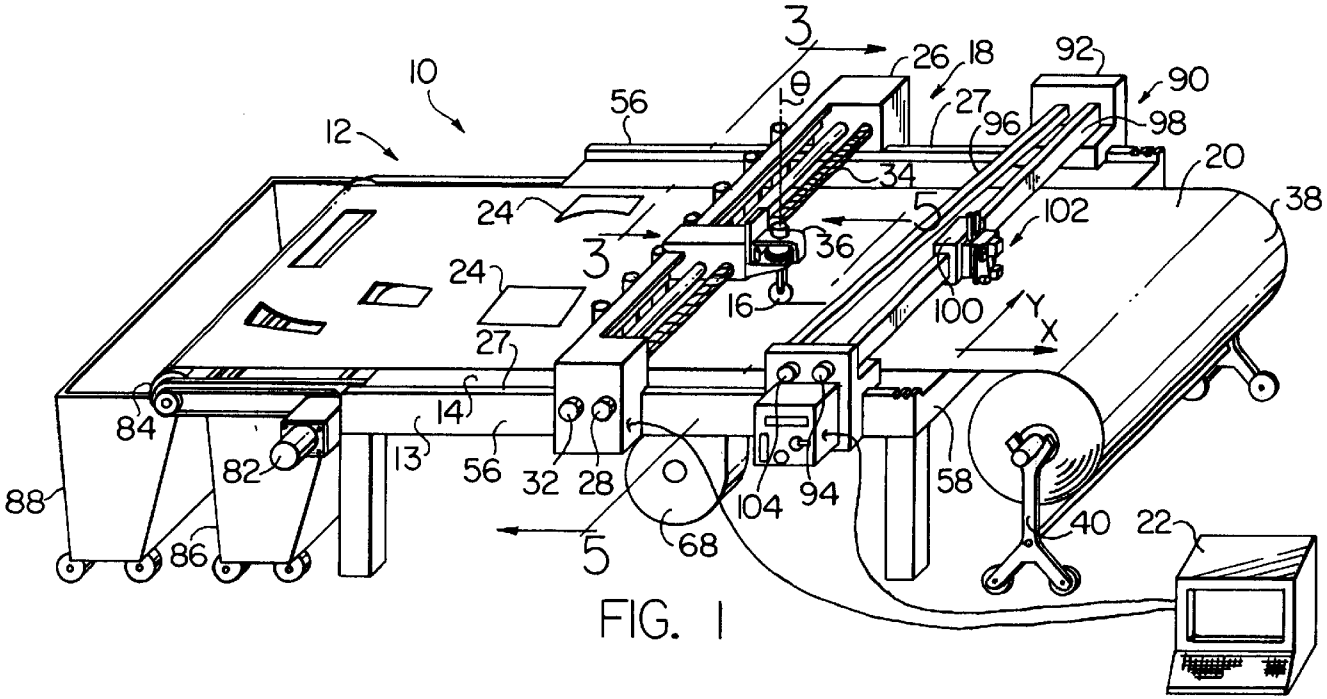
FIG. 1 is a perspective view of an apparatus for cutting pattern pieces from sheet material embodying the invention.

FIG. 1 is a perspective view of an automatically controlled cutting apparatus 10 embodying the invention. The method of cutting pattern pieces encompassed by the invention will be disclosed in conjunction with the description of the apparatus.

The apparatus 10 comprises a vacuum hold-down table assembly, generally designated 12, including a stationary table 13 defining a generally horizontally disposed work surface 14. The apparatus further includes a cutting instrument, which in the illustrated embodiment is a cutting wheel 16, and a carriage assembly indicated generally at 18 for moving the cutting wheel 16 in rolling cutting engagement with the work surface 14 to cut sheet material, such as the sheet a fabric 20, spread on the work surface.

The carriage assembly 18 is supported on the table 12 to move the cutting wheel 16 in longitudinal (X) and transverse (Y) directions relative to the work surface 14 in response to command signals received from a microprocessor-based design and control unit 22. The cutting wheel 16 is further arranged for angular movement about a θ axis generally perpendicular to the work surface 14 in response to further command signals from the unit 22.

The design and control unit includes a computer aided design system for receiving and storing data representing a plurality of made to order garments. As noted above a made to order garment means either a standard-sized garment manufactured for a specific individual, a custom fitted garment manufactured for a specific individual based on the individual's physical measurements, or a garment manufactured from a prototype design. For example, in the case where a custom fitted pair of women's blue jeans is requested, data representing the individual's hip, waist, inseam and rise measurements are transmitted electronically from the location where the measurements are taken to the unit 22. The design portion of the unit 22, which may be any well-known computer aided design system known to those skilled in the art, is then utilized by an operator to create a digital representation of a pair of jeans custom fitted to the individual's measurements.

Data representing any number of made to order garments are received by the design and control unit 22, and the unit 22 incorporates the various digital representations of the garments into a continuous marker which, as stated above, provides a set of instructions that defines the pattern pieces comprising individual garments or groups of garments, such as the pattern pieces 24, 24, and arranges the pieces together as they are to be cut from successive bites of the fabric 20. That is, the marker if formed sequentially, beginning at one end, by sequentially adding pattern pieces corresponding to individual garments or groups of garments to allow cutting of all of the pieces comprising the garment or group of garments before the marker is completed.

In order to make optimum use of the fabric, the continuous marker controls or adjusts the size of each bite of fabric and, when necessary, combines pattern pieces comprising garments for different individuals onto the same bite or segment of fabric. Further, the marker preferably sizes each bite of fabric to avoid partial cutting of pattern pieces. To cut pattern pieces from the fabric 20 according to the marker, the marker instructions are converted by the control portion of the unit 22 into the command signals that direct the carriage assembly 18 for movement in the illustrated (X) and (Y) coordinate directions and the cutting wheel 16 for rolling cutting engagement with the work surface 14.

Referring now to FIGS. 1–4 and the carriage assembly 18 in more detail, the assembly includes an X-carriage 26 which is accurately guided for movement in the X-coordinate direction by ways 27, 27 which extend longitudinally along opposite sides of the table 13. An X-drive motor 28 receives command signals from the unit 22 and rotates pinions (not shown) which engage racks (also not shown) at opposite sides of the table to accurately translate the X-carriage to various positions relative to the work surface 14.

The carriage assembly 18 further includes a Y-carriage 30 supported on a bridging portion of the X-carriage to move transversely of the table 13 in the Y-coordinate direction. A Y-drive motor 32, which receives command signals from the design and control unit 22, rotates a lead screw 34 which extends in the Y-coordinate direction and is threadably engaged with the Y-carriage to accurately position it in the Y-direction.

The cutting wheel 16 is mounted on a Z-carriage 36 carried by the Y-carriage 30. The Z-carriage moves the cutting wheel 16 into and out of contact with the fabric 20 and rotates the cutting wheel about the θ axis in response to command signals from the unit 22.

The cutting apparatus 10 is designed for cutting pattern pieces from successive bites or segments of sheet material drawn from a supply roll, such as the roll 38 mounted on movable support frame 40. Since the fabric comprising the roll is considerably longer than the table 13, a coupling mechanism 42 is provided for coupling the fabric to the carriage assembly 18 to intermittently advance the fabric over the work surface 14. As shown in FIGS. 1–4, the coupling mechanism comprises at least on frictional coupling unit 44 for releasably frictionally coupling the fabric to the carriage assembly. The illustrated cutting apparatus includes a plurality of such units 44, 44 which are mounted in transversely spaced series along the X-carriage 26 to travel back and forth in the X-coordinate direction therewith. In the illustrated embodiment of the apparatus 10, the coupling units 44, 44 are mounted on the side of the X-carriage opposite the supply roll 38. While such an arrangement is not required, it avoids the possibility of cut fabric being jammed under the X-carriage when the material is advanced.

Figure 2:
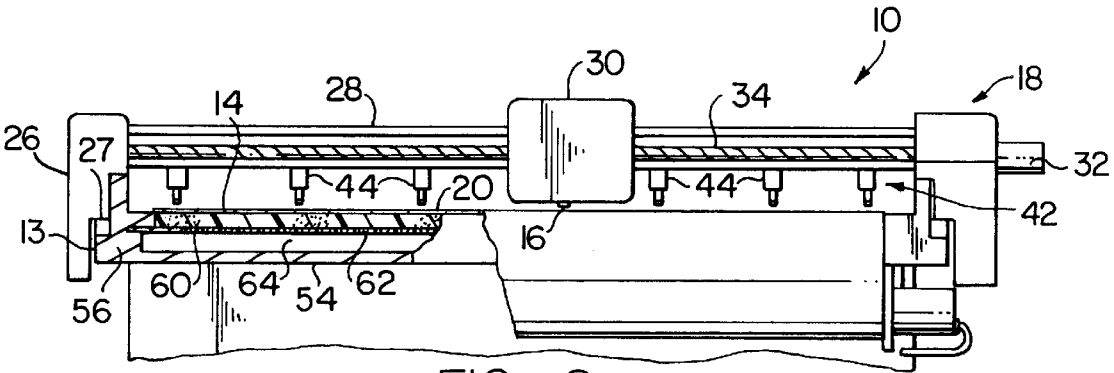
FIG. 2 is a fragmentary end elevational view of the apparatus illustrated in FIG. 1.
Figure 4:
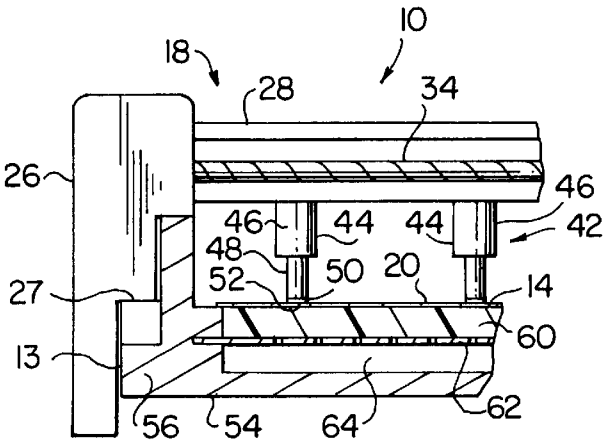
FIG. 4 is similar to FIG. 3 but shows the coupling units in their coupled position.
Figure 3:
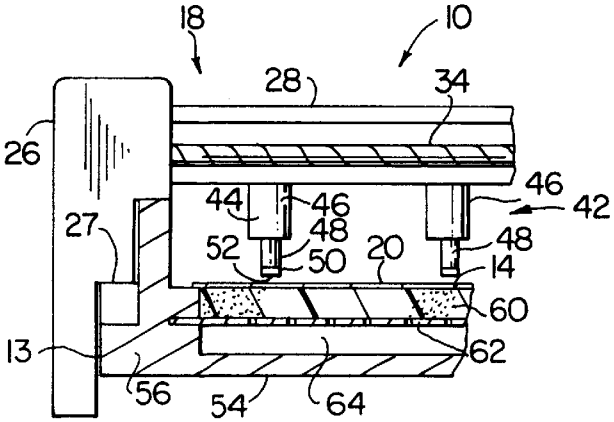
FIG. 3 is a somewhat enlarged fragmentary sectional view taken along the line 3—3 of FIG. 1 showing the coupling units in their uncoupled position.

Referring in particular to FIGS. 2–4, each coupling unit 44 includes a drive motor or electrical solenoid 46 which is mounted on the X-carriage 28 and which has a movable part or plunger 48. A friction shoe 50 made from high-friction material, such as rubber, cork or the like, is mounted in fixed position at the lower end of the plunger 48 and has a high-friction surface 52 disposed generally parallel to the work surface 14. Each plunger 48 is movable generally toward and away from an opposing portion of the work surface 14 between coupled and uncoupled positions. When the coupling unit 44 is in its coupled position the high-friction surface 52 is disposed in frictional gripping engagement with the upper surface of the fabric 20 supported on the work surface 14, as shown in FIG. 4, the lower surface of the fabric being in direct contact with an associated opposing portion of the stationary work surface 14. When the coupling unit 44 is in its uncoupled position, the friction shoe is disposed a substantial distance above the work surface so that its high-friction surface 52 is out of frictional engagement with the fabric 20, as shown in FIG. 3.

Figure 5:
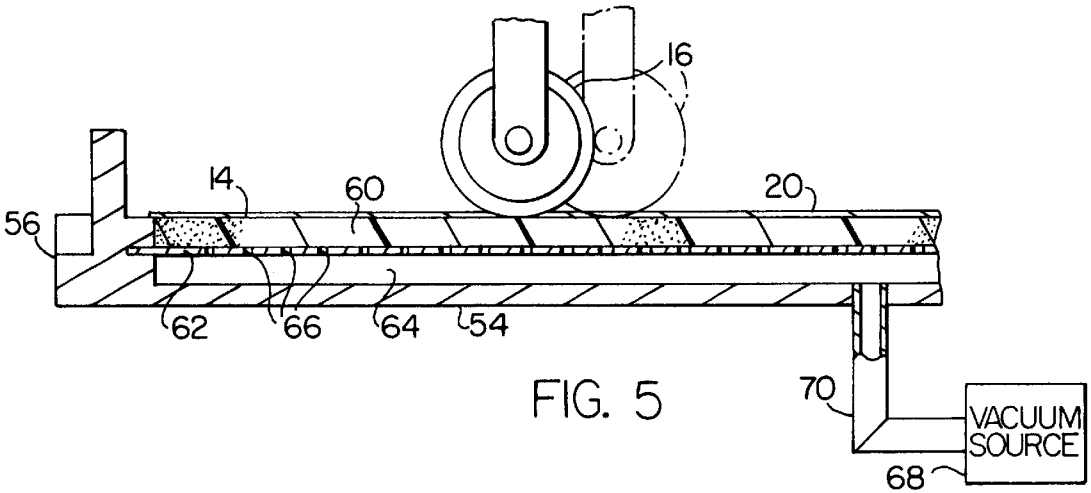
FIG. 5 is a somewhat enlarged fragmentary sectional view taken along the line 5—5 of FIG. 1 but showing the apparatus somewhat schematically.

Before describing the manner in which the carriage assembly 18 and the coupling mechanism 42 advance successive segments of fabric from the supply roll 38 onto the work surface 14, the table 13 will be considered in more detail. Referring now to FIGS. 1 and 5, the table 13 includes a bottom wall 54, side walls 56, 56 and end walls 58, 58 defining an upwardly open shallow cavity. A layer 60 of a fluid permeable material is supported on the table 13 within the cavity by base plate 62. The upper surface of this layer defines the work surface 14. The base plate 62 is preferably made from metal and is supported on the side walls 56, 56 and end walls 58, 58. The base plate 62 cooperates with the bottom wall 54, the side walls 56, 56 and the end walls 58, 58 to define a vacuum plenum 64. A plurality of passageways 66, 66 are formed in the base plate which provide fluid communication between the plenum and the layer of fluid permeable material 60. A vacuum source 68, shown schematically in FIGS. 1 and 5, communicates with the plenum 64 and the passageways 66, 66 via an associated conduit 70 connected between the vacuum source and the table bottom wall 54. Thus, vacuum is applied through the fluid permeable layer 60 to the work surface 14 to hold the fabric 20 firmly against the surface during a cutting operation.

In the preferred embodiment of the invention, the layer 60 comprises a high density polyethylene filter material having a pore size of about 80 microns. Such a material is available from, for example, Pore Technology, Framingham, Mass. The use of this material provides not only a well dispersed, evenly applied vacuum at the work surface 14, but also a uniform work surface as the cutting wheel is directed along a cutting path by command signals from the control unit to cut the fabric 20.

While the layer 60 is formed from the above-described filter material in the preferred embodiment of the invention, it should be understood that the invention is in no way limited in this regard. Other known fluid permeable materials which provide a uniform work surface could also be used to form the layer 60, such as, for example, porous cardboard, sintered metal, rigid, porous foam or air permeable paper.

Having described the carriage assembly 18 and the table 13, the operation of the cutting apparatus 10 to advance fresh segments of the fabric 20 onto the work surface 14 for cutting will now be explained. At the beginning of a cutting cycle, the carriage assembly 18, under the direction of the design and control unit 22, moves in the X-coordinate direction toward the supply roll 38 a distance which approximately equals the length of the next successive bite of fabric to be advanced onto the work surface. This distance is only approximate since the control unit must insure that when the coupling units are moved to the coupled position they do not engage an area or fabric substantially consumed by cut pattern pieces. When the carriage assembly is appropriately positioned, another signal from the control unit 22 causes the coupling units 44, 44 to move to the coupled position. The carriage assembly 18, which is now frictionally coupled to the fabric 20 by the various coupling units 44, 44 comprises the prime mover for precisely advancing the fabric 20 in the opposite direction, away from the supply roll 38 and relative to the work surface 14. While a fresh segment of fabric is being advanced onto the work surface, a means for tensioning the sheet material applies an appropriate degree of tension to the fabric to prevent it from folding on itself as a fresh bite of fabric is pulled onto the work surface 14. As shown in the embodiment of FIG. 1, the tensioning means includes a torque motor 82 and its associated take-up roll 84 which cooperate to apply the appropriate degree of tension to the fabric. This is accomplished by slaving the motor 82 to the carriage assembly 18. Thus, as the carriage is directed in the X-coordinate direction away from the supply roll 38, the motor 82 is energized by the design and control unit 22 to apply driving torque in its associated take-up roll and a pulling force to the fabric 20 ahead of and in coordination with the assembly 18. Advancement of the fabric 20 may also be assisted by reversing the vacuum from the vacuum source 68 to blow air up through the layer 60 and reduce friction between the work surface 14 and the fabric. Furthermore, in the case where the limp sheet material lacks sufficient dimensional stability, it may be necessary to drive the supply roll as the material is advanced onto the work surface by the carriage assembly.

When the carriage assembly 18 and the fabric 20 have advanced to the desired limit of the assembly's travel in the X-coordinate direction away from the supply roll 38, the carriage comes to rest momentarily. The vacuum hold-down system is then energized on signal from the control unit 22 to hold the fresh segment of fabric in stationary position on the work surface 14. Further signals from the control unit 22 move the frictional coupling units 44, 44 to the uncoupled position and cause the Z-carriage to move the cutting wheel 16 into engagement with the fabric 20, whereupon composite movement of the carriage assembly 18 in response to command signals from the design and control unit 22 cause the cutting wheel to cut a plurality of pattern pieces 24, 24 from the fabric 20 according to the instructions provided by the continuous marker.

When the cutting operation is complete for a given bite of fabric, a fresh bite of the fabric is moved onto the work surface as described above. A bin 86 is provided between the end of the table 13 and the take-up roll 84. As the fabric 20 is pulled over the top of the bin by the take-up roll, gravity causes the cut pattern pieces 24, 24 to separate from the surrounding fabric and fall into the bin 86 for subsequent collection and processing. The remainder of the fabric comprising the scrap portion is directed by the take-up roll 84 into a container 88 positioned at the end of the apparatus 10. In one embodiment of the invention, a fan is positioned above the fabric 20 in vertical alignment with the bin 86. Downwardly directed air flow from the fan assists in separating the cut pattern pieces from the scrap fabric by pushing the pattern pieces down into the collection bin. Alternatively, the collection bin 86 is provided with vacuum which is applied to the underside of the fabric 20 to drawn the cut pattern pieces down into the bin. In this embodiment, the bin is either provided with its own vacuum system, or vacuum is applied by the vacuum source 68 via a conduit connecting the vacuum source to the collection bin 86.

Since, as previously mentioned, each segment or bite of fabric contains multiple pattern pieces, some of which may comprise garments made to order for different individuals, it is essential that each pattern piece be identified not only as to which part of the garment it comprises, but also as to the particular garment to which it belongs. Accordingly, the apparatus 10 also includes a labeling apparatus, generally indicated at 90, which includes a labeling carriage 92 supported for movement in the X-coordinate direction on ways 27, 27. An X-drive motor 94 receives command signals from the design and control unit 22 and rotates pinions (not shown) which engage racks (also not shown) at opposite sides of the table to accurately translate the X-carriage to various positions relative to the work surface 14. The labeling carriage 92 further includes a structural beam 96 and a guide rail 98 extending transversely of the work surface 14. The guide rail 98 supports a work carriage 100 for movement along its length in the Y-coordinate direction and carries a labeler 102. Movement of the work carriage 100 along the length of the of the rail 98 is effected by suitable drive means including a Y-drive motor 104, which receives command signals from the design and control unit 22 to accurately position the work carriage in the Y-coordinate direction. Thus, by combined movements of the labeling carriage in the X-coordinate direction and the work carriage in the Y-coordinate direction, the labeler 102 can be positioned with respect to the work surface 14 to affix a label to each pattern piece 24, 24 to be cut from the fabric 20. Of course, the movement in the X-coordinate direction can be eliminated by starting and stopping the carriage assembly 18 when the label is applied, or by advancing the carriage assembly slowly so that the label can be applied while the assembly is moving.

Figure 7:
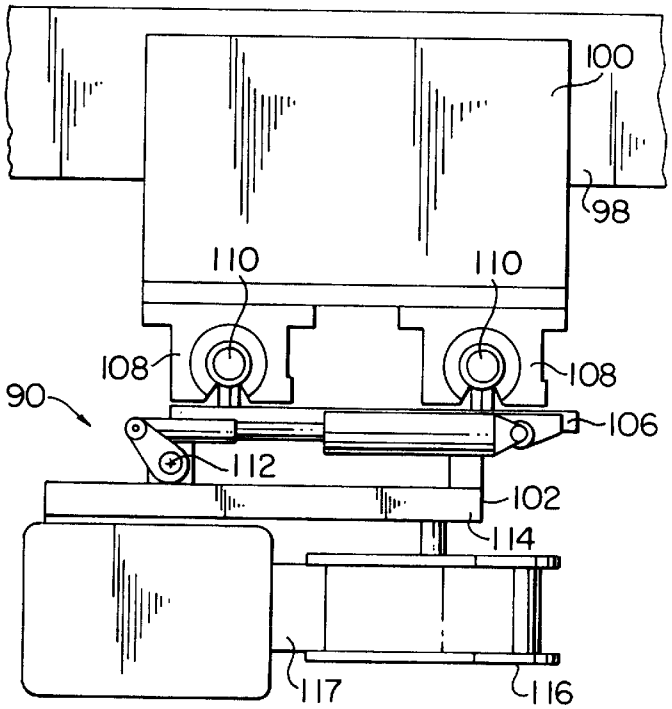
FIG. 7 is a schematic plan view of the labeler of FIG. 6.
Figure 6:
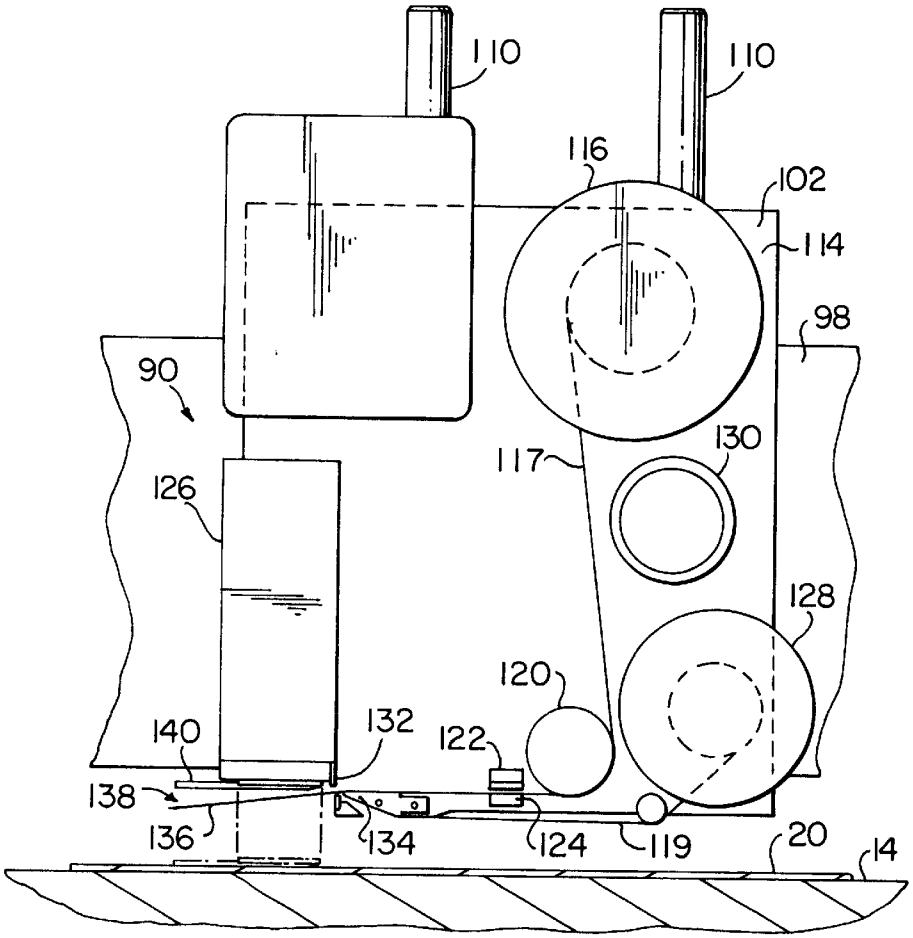
FIG. 6 is a schematic front elevational view of the labeler which forms a part of the labeling device of the apparatus shown in FIG. 1.

As shown schematically in FIGS. 6 and 7, the labeler 102 comprises a base plate 106 carried by the work carriage 100 by means of two guide bushings 108 fixed to the carriage 100. Two guide rods 110 fixed to the base plate 106 are slidably received by the bushings 108 to permit vertical sliding movement of the base plate relative to the work carriage. A suitable adjustment means (not shown) adjustable holds the base plate 106 at a selected vertical height relative to the work carriage 100 to cause the base plate and the remainder of the labeler to be located at an optimum height above the top surface of the fabric 20. Pivotally connected to the base plate 106 for rotation about a vertical θ axis 112 is a carrier plate 114. Mounted on the carrier plate 114, as best seen in FIG. 7, is a supply spool 116 for holding and receiving a label supply means in the form of an elongated strip of labels 117. Also mounted on the carrier plate 114 is an idler guide roll 120, a printing unit 122, a platen 124, a label cutting and application mechanism 126, a take-up spool 128, and a motor 130 which through a suitable drive train powers the take-up spool 128.

Figure 8:
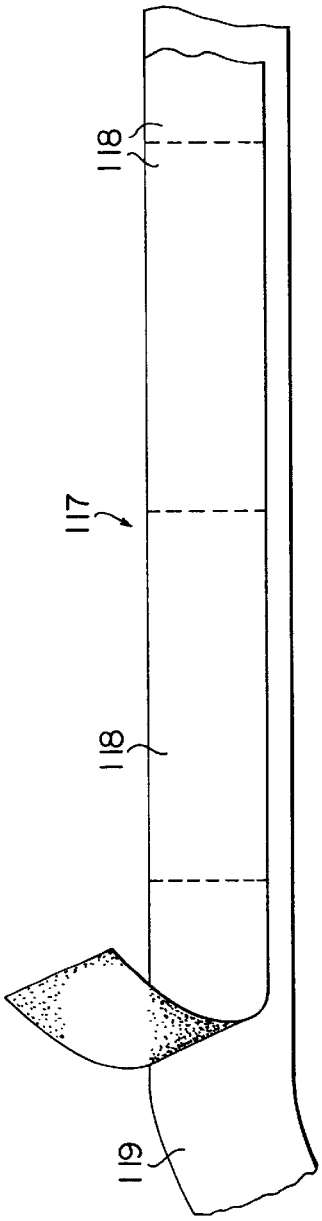
FIG. 8 is a plan view of a strip of labels carried by the labeler illustrated in FIG. 6.

Referring now to FIGS. 7 and 8, the strip of labels 117 comprises a plurality of adhesive labels 118, 118 releasably supported on a carrier strip 119. The strip 117 passes from the supply spool 116 over the idler guide roll 120 to the printing unit 122. As the labeler 102 is directed to a position with respect to the work surface 14 corresponding to a particular pattern piece 24, the motor 130, under the direction of the design and control unit 22, advances the strip of labels 117 by powering the take-up spool 128 in the take-up direction of rotation so that the forwardmost label in the strip comes to rest supported on the platen 124. The printing unit 122, also under in the direction of the design and control unit 22, is then activated to print garment information onto the label indicating the garment part that the particular pattern piece comprises as well as the garment to which that pattern piece belongs. It should be understood that the printing unit 122 may be of any known kind, such as thermal transfer, dot matrix, ink jet, etc.

After the printing operation is complete, the motor is again activated to advance the strip 117 to bring the printed label to the cutting station 132 of the cutting and applicator mechanism 126. At this station, the strip of labels 117 is pulled over a sharp stationary nose 134 of small radius causing the printed label (indicated here at 136) to be stripped from the carrier strip 119 and to move forwardly to the applicator station 138 while the carrier strip 119 moves rearwardly to the take-up spool 128. When the labeler 102 is at a position relative to the work surface 14 corresponding to the particular pattern piece to be labeled, the label cutting and application mechanism 126 is actuated by a command signal from the control unit 22 which moves a pair of knives at the cutting station 132 past each other to sever the printed label 136 from the strip of labels 117. After the label 136 has been cut from the strip 117, a presser plate 140 is moved downwardly from the full line position to the broken line position shown in FIG. 7 to forcibly carry the severed label downwardly and to press it into adhered relationship to the top surface of the fabric 20.

Figure 9:
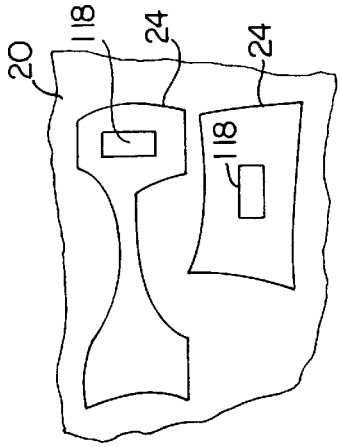
FIG. 9 is a plan view of the sheet material including labeled pattern pieces.

From the foregoing it will be understood that in response to command signals from the design and control unit 22, the labeling apparatus 90 adheres the appropriate label onto each pattern piece 24, 24, as shown in FIG. 9. Thus, after the cutting wheel 16 cuts the pattern pieces 24, 24 from the fabric 20 pursuant to the instructions provided by the continuous marker, each cut pattern piece includes a label bearing garment information specifying which garment part each pattern piece comprises and to which particular garment the part belongs.

Figure 11:
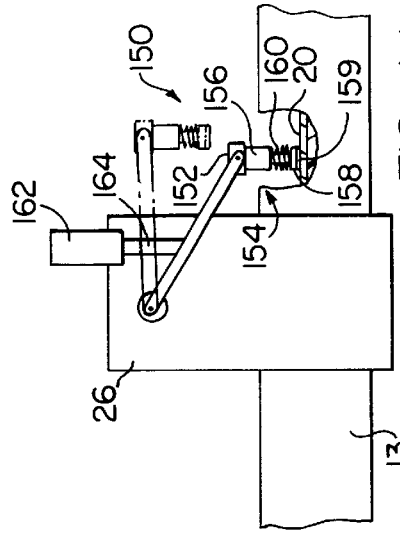
FIG. 11 is a side elevational view of the coupling units shown in FIG. 10.
Figure 10:
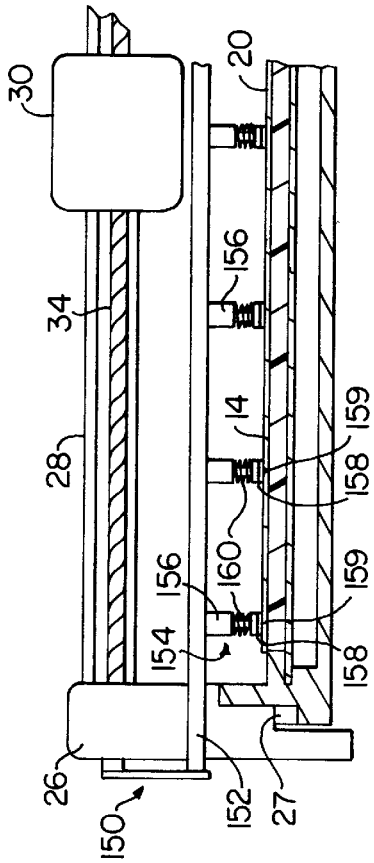
FIG. 10 is a somewhat enlarged fragmentary sectional view of a second embodiment of the coupling unit which forms a part of the apparatus shown in FIG. 1 taken along the line 3—3 of FIG. 1.

While a preferred embodiment of the present invention has been shown and described, various modifications and substitutions may be made without departing from the spirit and scope of the invention. For example, an alternative embodiment of the coupling mechanism 42 is shown in FIGS. 10 and 11. In this embodiment, the coupling mechanism, generally indicated at 150, comprises a bar 152 movable supported on the X-carriage 26 between coupled and uncoupled positions. A plurality of coupling units, shown generally at 154, 154, are mounted in transversely spaced series along the bar 152 to travel back and forth with the carriage assembly 18 in the X-coordinate direction. Each coupling unit 154 includes a mounting bracket 156 for mounting the unit to the bar 152, a shoe 158 having a gripping surface 159 made from a high-friction material such as rubber, cork or the like, and a spring 160 which biases the shoe downwardly away from the bar 152 and toward the work surface 14.

As shown in full line in FIG. 11, when the bar 152 is in the coupled position, each shoe 158 is disposed in frictional gripping engagement with the fabric 20 and is maintained in such engagement by the spring 160. In the uncoupled position, shown in phantom in FIG. 11, the bar is elevated to raise the shoes out of engagement with the fabric 20. As also shown in FIG. 11, an actuator 162 supported on the X-carriage and connected by a link 164 to the bar 152 moves the bar between the coupled and uncoupled positions in response to command signals received form the design and control unit 22. In the illustrated embodiment, a single actuator mounted at one end of the X-carriage is provided; however, two actuators mounted at either end of the carriage or a single actuator mounted in the middle of the carriage could also be employed.

It should be understood that while both of the illustrated coupling units 44 and 154 include a shoe having a high-friction surface, the surface could be replaced with a pin or hook for penetrating the fabric 20 when the units are in their coupled position. Thus, the pins or hooks engage the fabric 20 for corresponding movement with the carriage assembly 18 as the carriage assembly moves away from the supply roll 38 in the X-coordinate direction. It should be noted that the use of pins or hooks are particularly useful when using a plastic or paper overlay to enhance the vacuum applied to the fabric. In such a case, the pins or hooks penetrate the overlay to engage the fabric.

As a further modification to the illustrated embodiments of the invention, the bin 86 could be replaced by a computer controlled take-off device responsive to the label information for removing the cut pattern pieces 24, 24 from the remainder of the fabric 20 as disclosed in co-assigned U.S. Pat. No. 5,092,829.

Accordingly, it is to be understood that the present invention has been described by way of example and not by limitation.

I claim:

1. An apparatus for bite cutting pattern pieces for made to order garments from limp sheet material, said apparatus comprising:

a computer-aided design system for continuously receiving data representing a plurality of made to order garments and for continuously generating a marker in response to the data as the data representing the plurality of garments is received, said marker providing a set of machine readable marker instructions which defines contours of individual pattern pieces of the plurality of made to order garments, arranges the individual pattern pieces relative to one another as they are to be cut from one or more bites of the sheet material to optimize usage to the sheet material, and provides a specific length value for each bite of sheet material;

a carriage assembly for movably supporting a cutting tool over a stationary work surface on which the sheet of material is spread, said carriage assembly including a coupling mechanism for releasably coupling the sheet material to the carriage for movement therewith and relative to the table to advance successive bites of the sheet material onto the work surface;

a vacuum source in fluid communication with the work surface to hold the sheet material against the work surface; and a controller for converting the marker instructions into command signals to direct the carriage assembly to advance successive bites of the sheet material onto the work surface in accordance with said specific length values associated with each bite and to direct the movement of the carriage assembly and the cutting tool to cut the individual pattern pieces from the sheet material according to the marker instructions.

2. The apparatus of claim 1, wherein the work surface defines a maximum length value and wherein at least some of the specific length values provided by the set of marker instructions are less than the maximum length value.

3. The apparatus of claim 1, wherein the computer-aided design system and the controller form a design and control unit.

4. The apparatus of claim 3, wherein the design and control unit comprises a computer.

5. The apparatus of claim 1, wherein the computer-aided design system provides the set of machine readable marker instructions to arrange the individual pattern pieces of more than one garment relative to one another as the pieces are to be cut from at least one of the bites of the sheet material.

6. The apparatus of claim 1, wherein the computer-aided design system includes means for continuously generating the marker as data representing the plurality of made to order garments is received, the controller includes means for simultaneously directing the carriage assembly to advance successive bites of sheet material onto the work surface and for directing movement of the carriage assembly and the cutting tool to cut the individual pattern pieces from the sheet material according to the marker instructions.

7. The apparatus of claim 1, further including a labeling device for applying a label to each pattern piece to identify a particular one of the plurality of garments each pattern piece belongs.

* * * * *

UNITED STATES PATENT AND TRADEMARK OFFICE

CERTIFICATE OF CORRECTION

PATENT NO. : 6,308,602 B1
DATED : October 30, 2001
INVENTOR(S) : Heinz Joseph Gerber It is certified that error appears in the above-identified patent and that said Letters Patent is hereby corrected as shown below:

Column 9,
Line 16, after "sheet material" insert -- to avoid partial cutting of the individual pattern pieces on each bite of sheet material --

Signed and Sealed this

Eighth Day of June, 2004

JON W. DUDAS
*Acting Director of the United States Patent and Trademark Office*